US005476336A

United States Patent [19]

Osiecki et al.

[11] Patent Number: 5,476,336

[45] Date of Patent: Dec. 19, 1995

[54] ELECTRONIC ORGANIZER ATTACHMENT FOR BINDER OR BOOK

[75] Inventors: Scott W. Osiecki; David A. Furth, both of Skaneateles; Brad D. Hall, Unadilla, N.Y.

[73] Assignee: Cullman Ventures, Inc., New York, N.Y.

[21] Appl. No.: 398,671

[22] Filed: Mar. 6, 1995

[51] Int. Cl.[6] ..... B42D 13/00

[52] U.S. Cl. ..... 402/79; 281/51; 281/38; 283/117; 402/4; 402/80 K

[58] Field of Search ..... 281/28, 15.1, 21.1, 281/38, 51; 402/4, 79, 80 K, 73; 283/117

[56] References Cited

U.S. PATENT DOCUMENTS

| | | | |
|---|---|---|---|
| D. 338,455 | 8/1993 | Suge | D14/106 |
| 4,157,757 | 6/1979 | Gallaher, Jr. | 206/328 |
| 4,430,015 | 2/1984 | Nerlinger | 402/79 |
| 4,595,309 | 6/1986 | Chinchar | 402/80 R |
| 4,918,632 | 4/1990 | York | 364/708 |
| 5,058,736 | 10/1991 | Bedol | 206/214 |
| 5,186,565 | 2/1993 | Jack | 402/79 |
| 5,209,592 | 5/1993 | Bedol | 402/1 |
| 5,219,239 | 6/1993 | Bianco | 402/79 |
| 5,232,301 | 8/1993 | Bianco | 402/73 |
| 5,240,340 | 8/1993 | Lynch et al. | 402/79 |
| 5,290,118 | 3/1994 | Ozeki | 402/79 |
| 5,295,758 | 3/1994 | Bianco | 402/79 |
| 5,375,883 | 12/1994 | Wyant | 402/4 X |
| 5,409,319 | 4/1995 | Bedol | 402/4 X |

*Primary Examiner*—Willmon Fridie, Jr.
*Attorney, Agent, or Firm*—Trapani & Molldrem

[57] ABSTRACT

An electronic organizer assembly for attaches removably to a host book wherein said host book has a spine, a plurality of leaves or pages, and a plurality of ring members arranged along said spine for loosely retaining the leaves. The electronic organizer assembly has a body portion and a removable insert for removably attaching to the ring members of said host book. The insert has a flange for removably engaging the ring members, and an elongated slide engaging member, e.g., a rod, that extends along the flange. The electronic organizer body has a work panel on a front face; and first and second slotted channels formed at longitudinal side edges of the rectangular body. The channels are profiled to match the slide engaging member. The electronic organizer can be changed over from a right-side to a left-side orientation by sliding the body longitudinally along said insert until the latter slides out of engagement with the first slide portion, flipping the body over to engage the second channel with the slide engaging member, and then sliding the body down until the body is fully engaged with said insert. In one preferred version the insert has a slide engaging portion of stepped profile. An electronic organizer can be joined by a hinge member to a notepad work platform of similar dimensions to the electronic organizer. The hinge member has slide engaging parts that slide into side channels of the electronic organizer and the work platform.

11 Claims, 9 Drawing Sheets

ELECTRONIC ORGANIZER ATTACHMENT FOR BINDER OR BOOK

BACKGROUND OF THE INVENTION

The present invention relates to inserts and attachments for notebooks, workbooks, and other types of binders in which leaves or sheets of paper are loosely bound. The invention is more specifically directed to an electronic organizer, that is to a device that can be inserted into the binder to assist a person with computations, record-keeping, or the like while working with the binder. The electronic organizer can include a calculator, a small "palm-top" computer, an electronic address list, an electronic calendar and scheduler, or other similar device.

For reasons of both convenience and efficiency, it is desirable to mount the electronic organizer directly in the binder between sheets or leaves, so that it is handy and visible to the user. Also, having the electronic organizer mounted on an insert in the binder assists the user in working while traveling, and prevents misplacement of the device. For optimal utility, the electronic organizer should be rotatable from a right-side to a left-side orientation within the binder without having to remove the insert from the binder rings.

A number of combinations of a calculator or similar device with a ring binder or other host book have been proposed. Several of these have means incorporated in their inserts for rotating or flipping the electronic device, but the designs have been somewhat elaborate and cumbersome.

Several varieties of a rotatable notebook or binder insert for this purpose are described in Bianco U.S. Pat. No. 5,295,758, Bianco U.S. Pat. No. 5,232,301, and Bianco U.S. Pat. No. 5,219,239. Bianco '758 describes a rotatable binder attachment with slide action. In this concept, a calculator slides from left to right by way of grooves which are situated at the upper and lower ends of the calculator. The insert has two spaced-apart arms, one at the top and the other at the bottom of the calculator, and these arms engage the respective grooves on the calculator. Bianco '301 describes an electronic organizer attachment that can be secured to a ring binder. The attachment means includes a frame that connects to the outer cover or case of the binder (rather than to the rings), and a slip case that is pivotally connected to the frame. The calculator slides into the slip case. Bianco '239 describes another rotatable binder insert for a calculator or other electronic device. In this case, the insert is generally U-shaped with retention slots arranged along a spine of the insert. The U-shaped device defines a generally rectangular opening for the electronic device, which pivotally mounts onto the arms of the insert by means of grooves or cavities at upper and lower edges of the electronic device. In each of these arrangements, the electronic device has to be one specific size to fit the insert, and the device is held captive within the insert. This reduces flexibility in the use of the device. That is, it is not possible to change the insert to fit a different style of host book, or to replace the insert if it becomes damaged. It is also not possible to use different styles of electronic organizer with the same insert.

Various other notebook organizers have been proposed as well. Bedol U.S. Pat. No. 5,058,736 describes a notebook organizer with a ring attachable insert, in which a calculator, e.g., slides longitudinally in guide ways in the insert, Bedol U.S. Pat. No. 5,205,292 shows another notebook insert for a calculator. That insert contains standard ring holes for attachment to the binder rings, and the calculator is integrally fabricated with the insert. A hole punch is also included on the insert. Jack U.S. Pat. No. 5,186,565 shows a blank insert which slidably mates with a longitudinal pocket in a so-called pocket binder. The pocket binder can be pulled from the blank insert and used independently of the notebook. York U.S. Pat. No. 4,918,632 describes a notebook-mountable computer whose housing that contains a microprocessor, a display, and a keyboard. The computer housing has an upper section that contains openings that fit onto the rings of a ring binder. Nerlinger U.S. Pat. No. 4,430,015 relates to an insert that can be used with wire-bound notebooks, rather than split-ring binders.

OBJECTS AND SUMMARY OF THE INVENTION

Accordingly, it is an object of this invention to provide an electronic organizer and insert combination which avoids drawbacks of the prior art and which permits advantages not achievable previously.

It is a more specific object to provide an electronic organizer and insert that can be attached to a host book and which permits easy changeover from right- to left-page use.

It is another object to provide an electronic organizer that can be used with any of a variety of host books, and in which a variety of inserts can be employed with the same device.

It is a further object to provide the electronic organizer and insert with a simple, reliable design, and with a minimum of parts.

According to an object of this invention, an electronic organizer assembly is designed for removable attachment to a host book. The host book can be of any of a variety of styles, but having a spine, a plurality of leaves or pages, and a plurality of ring members arranged along the spine for loosely retaining the leaves. The host book, for example, can be a split-ring binder or a spiral or other wire-bound notebook. The electronic organizer assembly comprises in combination an insert for removably attaching to the ring members of the host book and an electronic organizer. Of course, the same attachment concept of this invention applies equally to other user work platforms, such as a notepad work platform.

The insert is of simple design, including a flange for removably engaging the ring members; and an elongated slide engaging member that extends in the direction along the spine, and having a predetermined profile. In one preferred embodiment, the insert is in the form of a flanged rod. In another, the insert is in the form of an attachment column having a slide member of stepped profile.

The electronic organizer has a flat, generally rectangular body, with at least one work panel (e.g., a calculator keyboard) disposed on a front face of the electronic organizer body. The body has first and second slide portions formed at longitudinal side edges, with each of these slide portions being profiled to match said slide engaging member. In this fashion, the electronic organizer can be changed over from a right-side to a left-side orientation by sliding the body longitudinally along said slide engaging member until the latter slides out of engagement with the first slide portion. Then the user flips the electronic organizer body over and engages the second slide portion with said slide engaging member. Following this, the user slides the body member back down so that the slide engaging member enters the second slide portion and slides along it until the body is fully engaged with said insert. In a preferred embodiment, the slide portions are channels, or tunnels, of generally round cross section whose profiles match the rod portion of the insert. The channels have a slot along their length to accommodate the flange of the insert. A locator tab can be inserted into the opposite channel.

In some embodiments, the insert is adapted for use with openable split-ring binder ring members, and said flange includes holes for engaging the ring members. In another embodiment, the insert is adapted for use with wire-bound host book in which the ring members are formed as a series of coils of wire, and the flange includes spade members for engaging between the coils of wire. Rather than an insert, a desk calendar base can receive the electronic organizer or other work platform.

In order to locate the electronic organizer properly along the insert and retain it in place, the slide engaging member has at least one protuberance formed as a detente thereon at a predetermined location, and each of the slide portions has a corresponding recess for engaging the detente when the respective slide portion fully engaged with the insert.

An assembly comprising the electronic organizer, a notepad work platform, an insertable hinge member, and latching tab members, permits the electronic organizer and the notepad to be used open together, and folded together when not in use.

The above and many other objects, features, and advantages of this invention will become apparent from the ensuing description of several selected preferred embodiments, which should be read in connection with the accompanying Drawing.

DETAILED DESCRIPTION OF A PREFERRED EMBODIMENT

Figure 1:
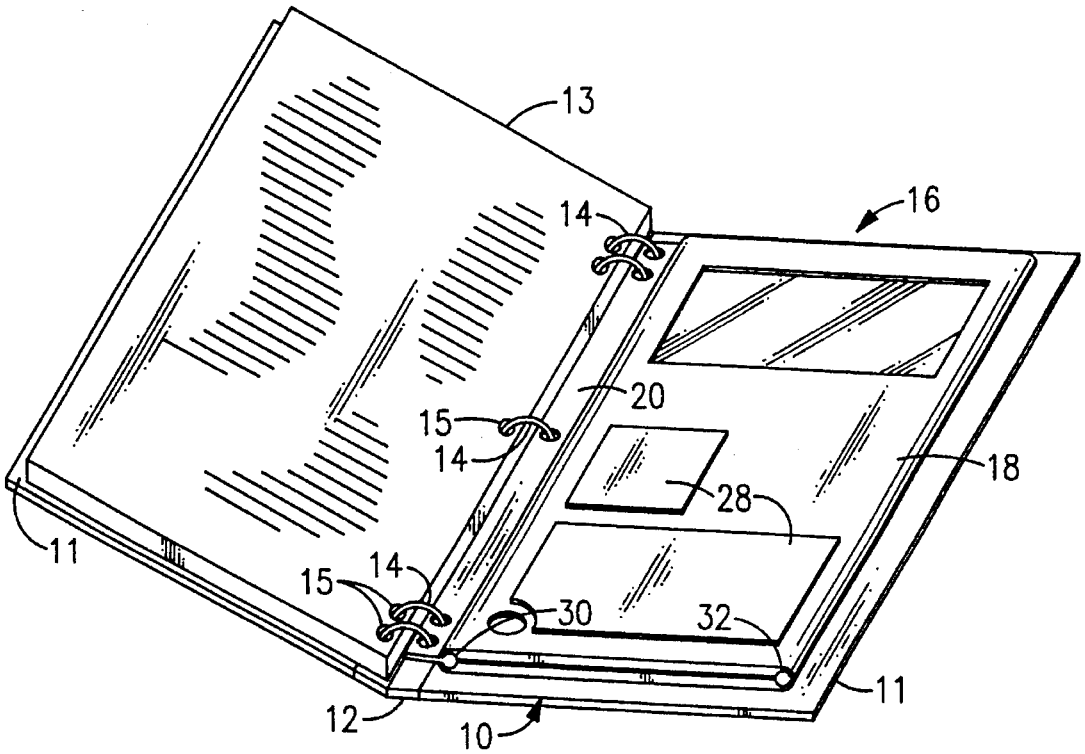
FIG. 1 is a perspective view of an electronic organizer attachment according to an embodiment of this invention, employed in combination with a host book, here in the form of a ring binder.

With reference to the Drawing, FIG. 1 shows a host book 10, here a ring binder having front and back covers 11 and a back or spine 12. The book 10 contains a number of pages or leaves of paper 13, which can be blank paper or preprinted forms, as suits the user's task. The leaves 13 are loosely bound on split rings 14 that are positioned along the spine 12. The rings open and close to permit papers and other items to be inserted or removed, and the leaves 13 are provided with holes 15 along one edge for that purpose. As also shown in FIG. 1, an electronic organizer assembly 16 is attached to the book or binder and is held in place on the rings 14 between the leaves or pages 13. The electronic organizer is shown here in a right-side orientation, that is, atop the right hand page, so that the user can use the same while recording computations and other information on the left-hand page or leaf. The electronic organizer assembly is also configured for easy change-over to left-side orientation so that the user can work on the right-hand page. The term electronic organizer is meant broadly to encompass any sort of electronic assistance device or combination of devices that can be mounted in the host book 10 to assist the user. These devices can include a calculator, an electronic address book, an electronic timer/datebook, or a small "palmtop" computer. The same mounting technique can be employed with a variety of other work platforms, such as a notepad platform.

Figures 5, 6, 7, 8:
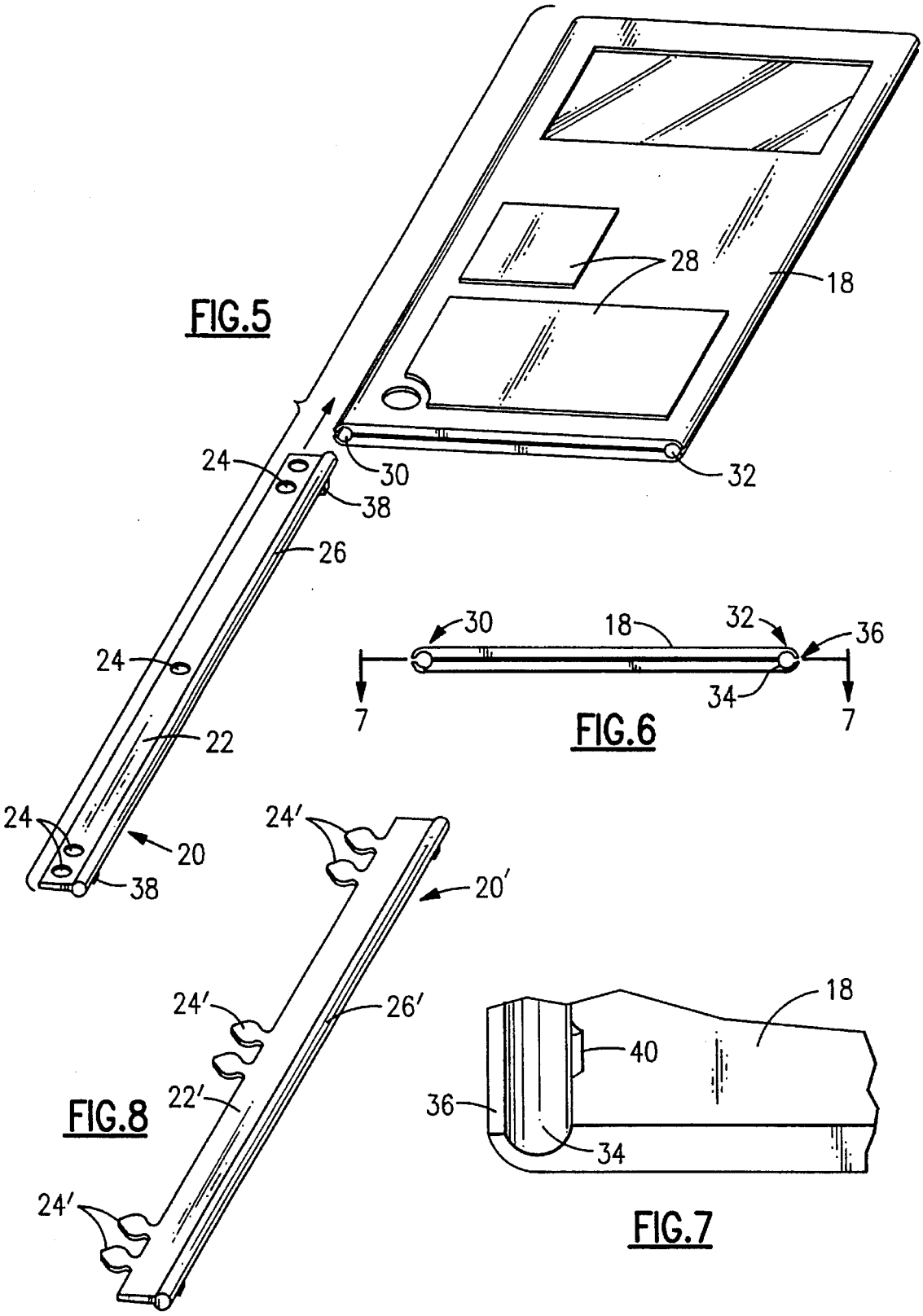
FIG. 5 is an assembly view of the electronic organizer and insert according to one preferred embodiment.
FIG. 6 is a cross-sectional view of the electronic organizer body.
FIG. 7 is a partial sectional view taken at 7—7 of FIG. 6.
FIG. 8 shows an alternative form of the insert according to an embodiment of this invention.

Turning now to FIG. 5, the electronic organizer assembly 16 is configured as a thin, flat member of about the same dimensions as the leaves 13 of paper, and about 0.25 inches thick. A generally rectangular body 18 contains the electronics as well as a keyboard and LCD display, as appropriate. The body 18 is removably attached onto an insert 20 that is mounted on the rings 14 of the host book 10. In this embodiment, the insert 20 is in the form of a flanged rod, with a flat elongated flange 22 extending along the spine 12 with holes 24 at positions to fit the split rings 14. A slide member 26, here in the form of a rod, extends along the flange, and has a round profile. The body 18 is shown to have electronics modules 28 disposed on a front face, and left and right channels 30 and 32, in the form of slotted channels or tunnels, along its right and left side edges. The channels 30 and 32 are here of round cross section that matches the profile of the rod or slide member 26, so that the channels can serve as slide portions to slide on the rod or slide member. As shown in FIG. 6, the slotted channels 30, 32 have a channel portion 34 of circular cross section and a slot communicating through the edge of the body 18 to accommodate the flange 22.

The slide member 26 of the insert 20 has a protuberances 38 near each end (FIG. 5) to serve as a detente, and the round channels 30 and 32 have corresponding recesses 40 (FIG. 7) to receive the protuberances 38 and hold the body 18 in place on the insert 20 when the slide member 26 of the insert is fully inserted into the channel 30 or 32.

An alternative embodiment of the insert is shown in FIG. 8, in which similar parts are identified with the same reference numbers as used previously, but primed. This insert 20' is intended for spiral or wire-bound workbooks, notebooks, or other host books, and can be removably inserted with the insert lodged between coils of the wire binding members of the host book. Here the insert has a flange 22' and rod 26' as previously described, but has a set of spade members 24' that extend from the free edge of the flange 22'. The spade members lodge between the coils or loops of wire, and retain the insert in place between pages or leaves of the book. The rod 26' has detentes or protuberances 38' similar to those of the previously-described embodiment.

Figure 2:
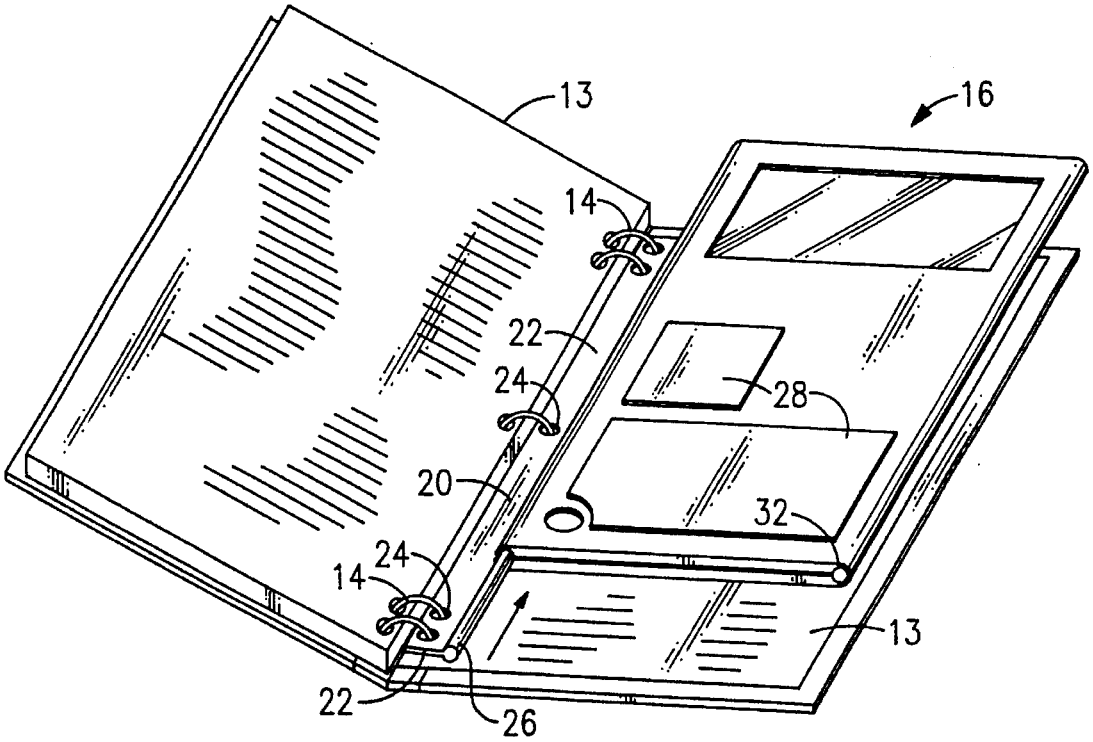
FIGS. 2, 3, and 4 are perspective views for showing operation of the slide insert for changing the position of the electronic organizer from one side of the host book to the other.
Figure 3:
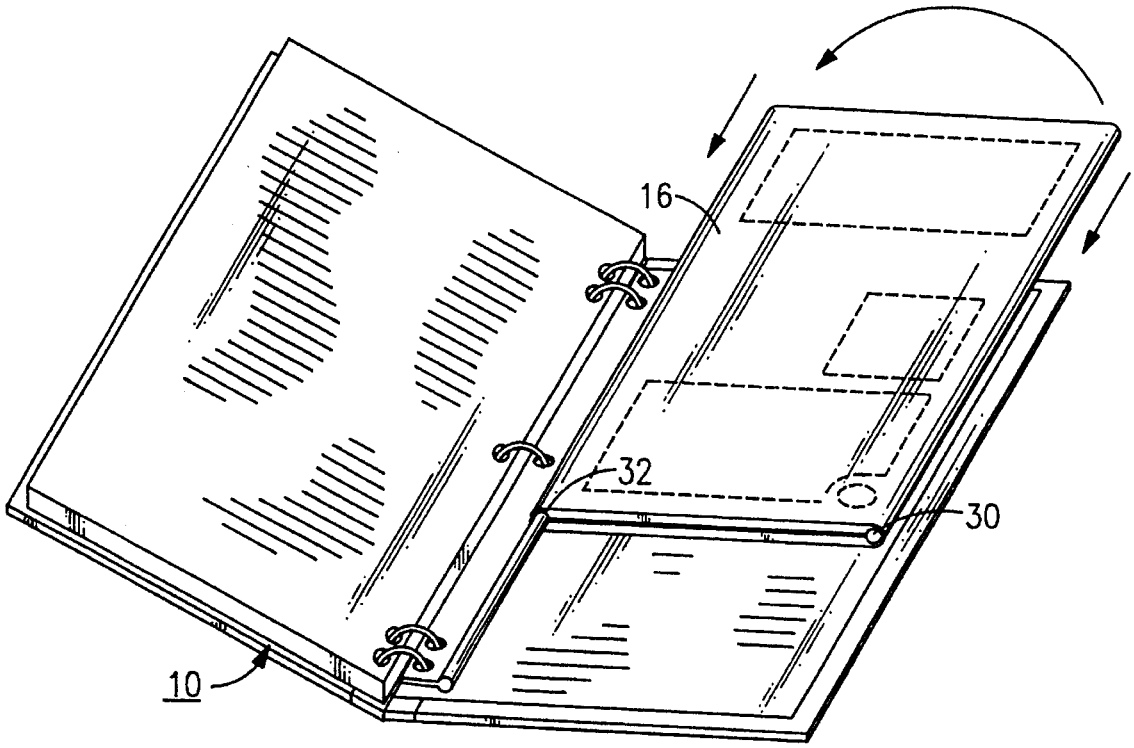
Figure 4:
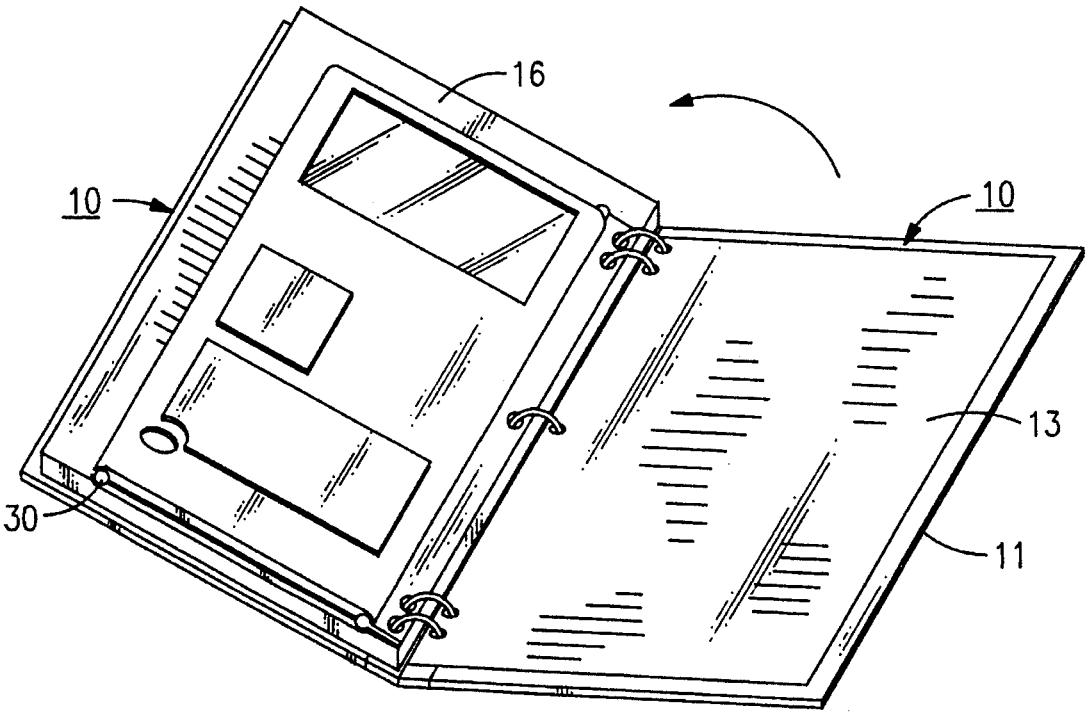

Returning now to FIG. 1, the change-over operation from right-side use to left-side use can be easily explained. As discussed above, FIG. 1 shows the electronic organizer assembly 16 positioned on the right side of the book 10, with the sheet or leaf on the left side exposed for recording of computations or the like. When the user has completed work on the left page, the electronic organizer 16 can be changed over to left side use, as shown in the sequence depicted in FIGS. 2, 3, and 4. First, the user slides the body 18 out along the insert 20 (FIG. 2), here towards the top of the book 10. At this time the slide member 26 is engaged in the left side channel 30. The user slides the channel 30 entirely out of engagement with the rod or slide member of the insert 20, and then turns the body over. The user then engages the right channel 32 onto the slide member 26, and slides the body 18 downwards (FIG. 3). Then when the slide member 26 is completely inserted into this channel 32, the protuberance 38 lodges in the corresponding recess 40 to locate the electronic organizer at a home position. Then, the user flips the entire assembly 16 at the spine and rings 14 (FIG. 4), so that the right side page or leaf is uncovered and available for the user to write on.

In this embodiment, the male portion of the slide, i.e., the rod or slide member 26, is disposed on the insert 20, and the female portion is situated in the body 18 as the channels 30 and 32. However, it is clearly within the realm of this invention to place the male slide members, i.e., elongated rods, at the sides of the body 18 and have a corresponding female slide member disposed on the insert 20.

It is clear that the same electronic organizer can be adapted for use with a variety of host books, simply by changing to a different insert, that is from the insert 20 to the insert 20' or to some other insert adapted for a specific host book or binder. Also, the insert can be easily and economically replaced if it becomes damaged.

A practical embodiment of this invention is shown in FIGS. 9, 10, 11, and 12, wherein elements that correspond to features of the previously-described embodiments are identified with similar reference numbers, but raised by 100.

Figure 11:
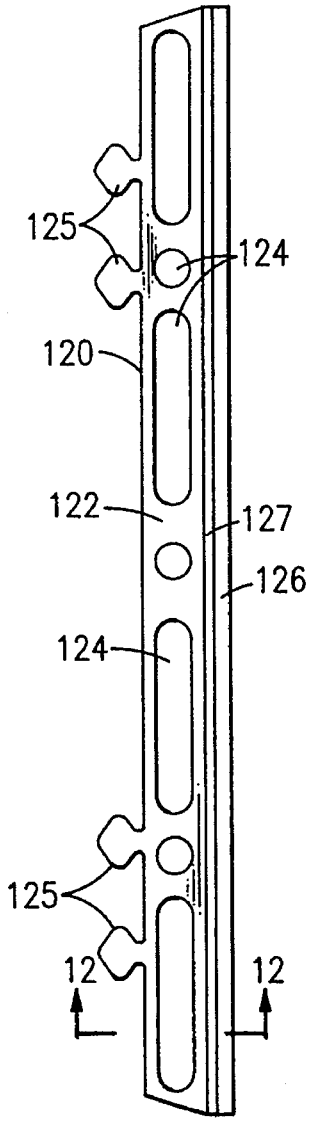
FIG. 11 is a plan view of an attachment column of this embodiment.
Figure 10:
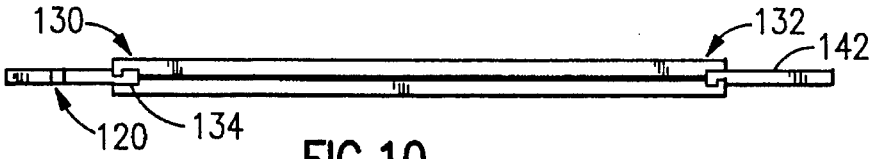
FIG. 10 is a cross sectional view taken at 10—10 of FIG. 9.
Figure 12:
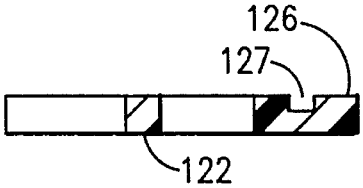
FIG. 12 is a cross sectional view of the attachment column taken at 12—12 of FIG. 11.

Here the electronic organizer assembly comprises an attachment column 120 and an electronic organizer 116. The attachment column 120 has both ring openings 124 and spiral binder attachment spades 125 on its flange portion 122. The attachment column here has a slide member 126 of stepped cross section, as shown in FIGS. 11 and 12, defining an elongated slot or groove 127 on one side. The body portion 118 of the electronic organizer has channels 130 and 132 on its left and right side edges, as shown in FIG. 10. The channels 130 and 132 have profiles that match the profile of the slide member 126 and at the entrance to each of the channels is a flange or ridge 133 that engages the corresponding slot or groove 127.

The electronic organizer assembly can be changed over from left side to right side use in the same manner as described previously.

Figure 9:
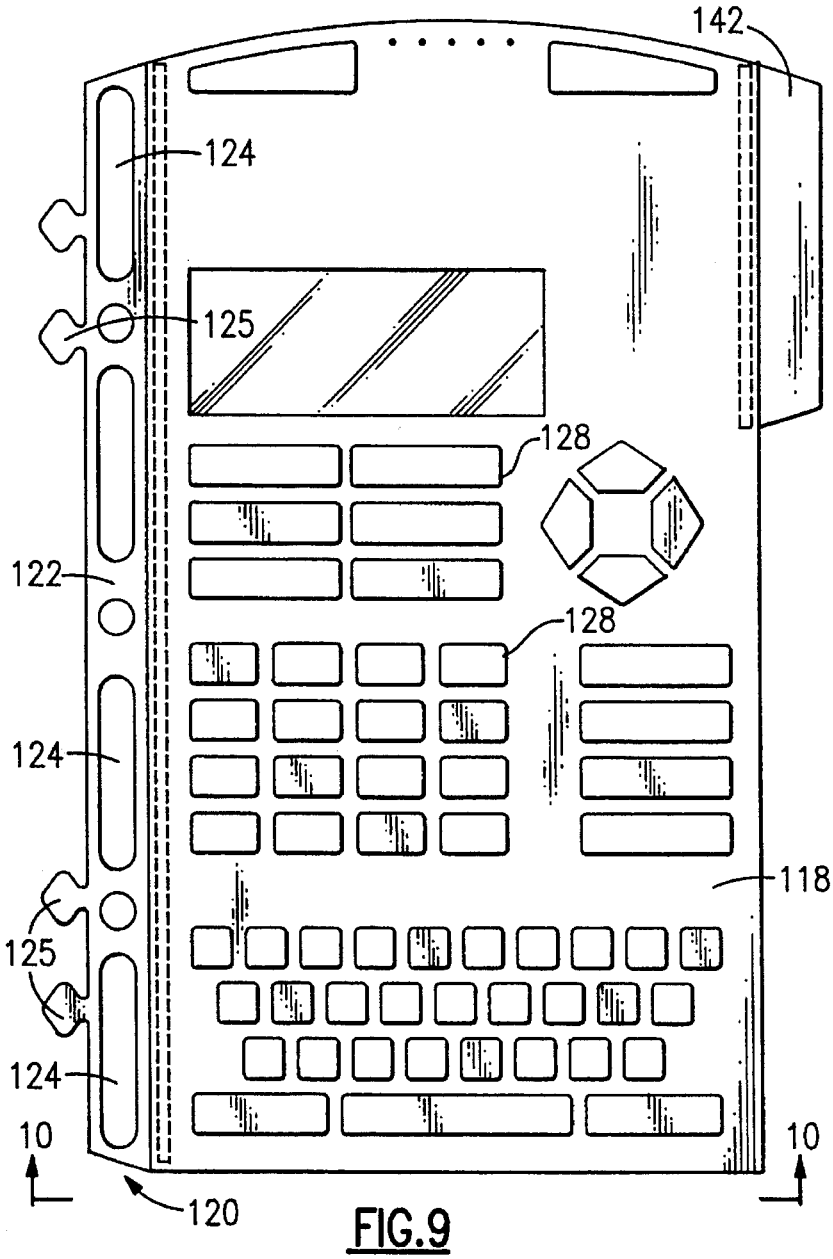
FIG. 9 is a plan view of an electronic organizer assembly according to another embodiment.

In the channel not used with the attachment column 120, e.g. in the channel 132 in FIGS. 9 and 10, a location tab 142 is installed. The tab 142 slides into place in the channel 132 and thus is removably inserted in the same manner as the attachment column. The tab 142 can be moved from one side to the other of the electronic organizer body 118 when changing over from right side to left side use. The attachment column and the tab have molded-in detent stops as described previously in respect to the first embodiment. The tab 142 can also be repositioned up and down along the channel 132, and need not be limited to the top position shown in FIG. 9.

The stepped design of the attachment column and the mating channels permits the attachment column to be much thinner, e.g., 0.050 inches. The electronic organizer 116 can be correspondingly thinner, e.g., 0.20 inches, so that it can fit more easily into the host book.

Figure 13:
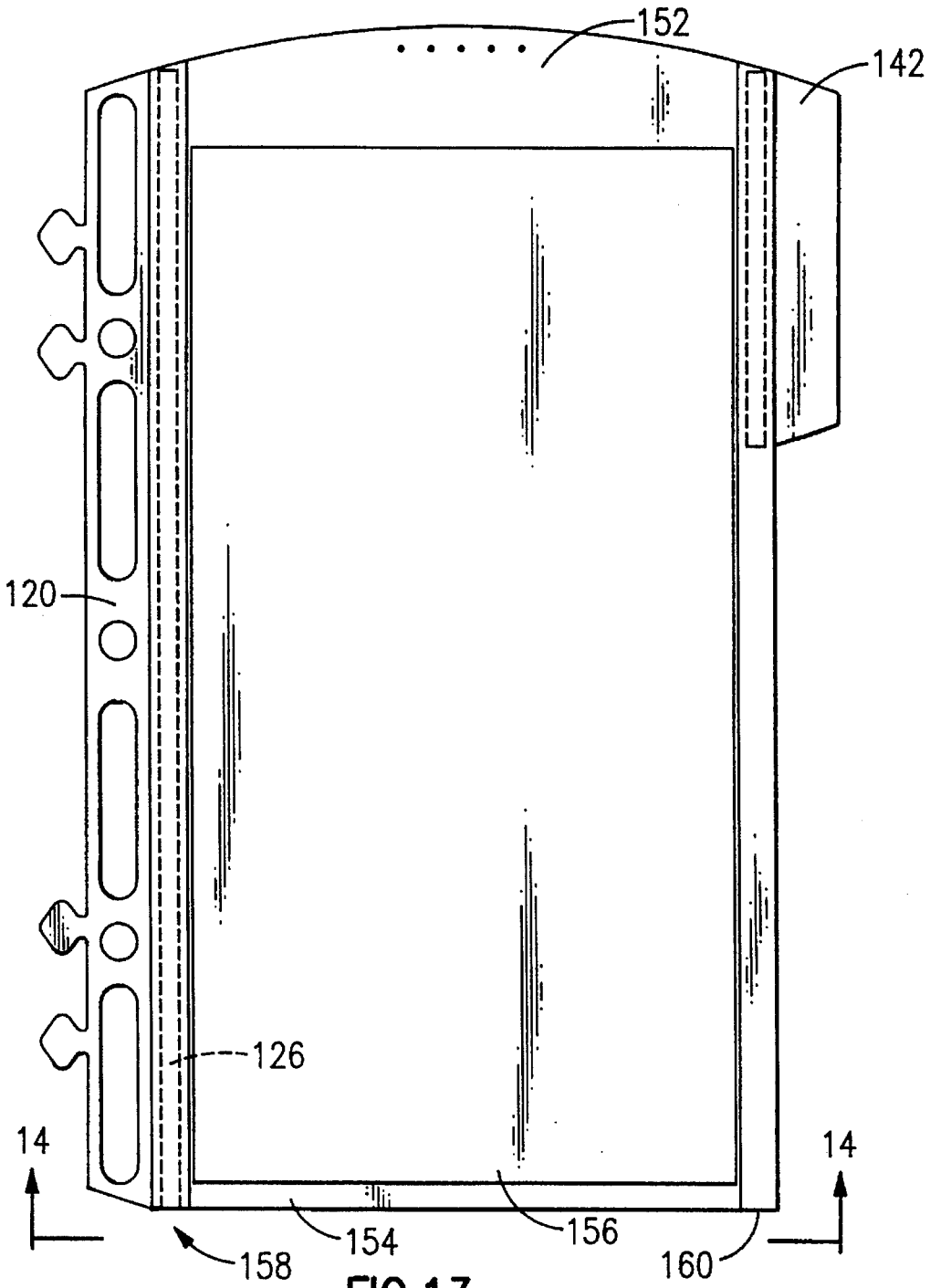
FIG. 13 is a plan view of a notepad work platform assembly according to an embodiment of this invention.
Figure 14:
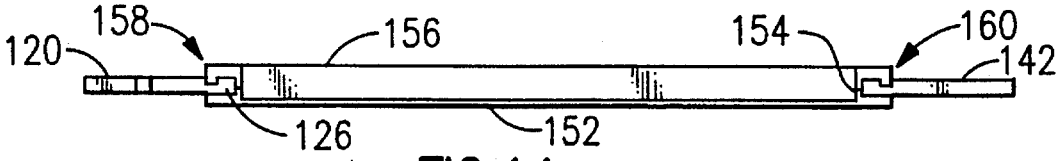
FIG. 14 is a cross sectional view taken at 14—14 of FIG. 13.
Figure 15:
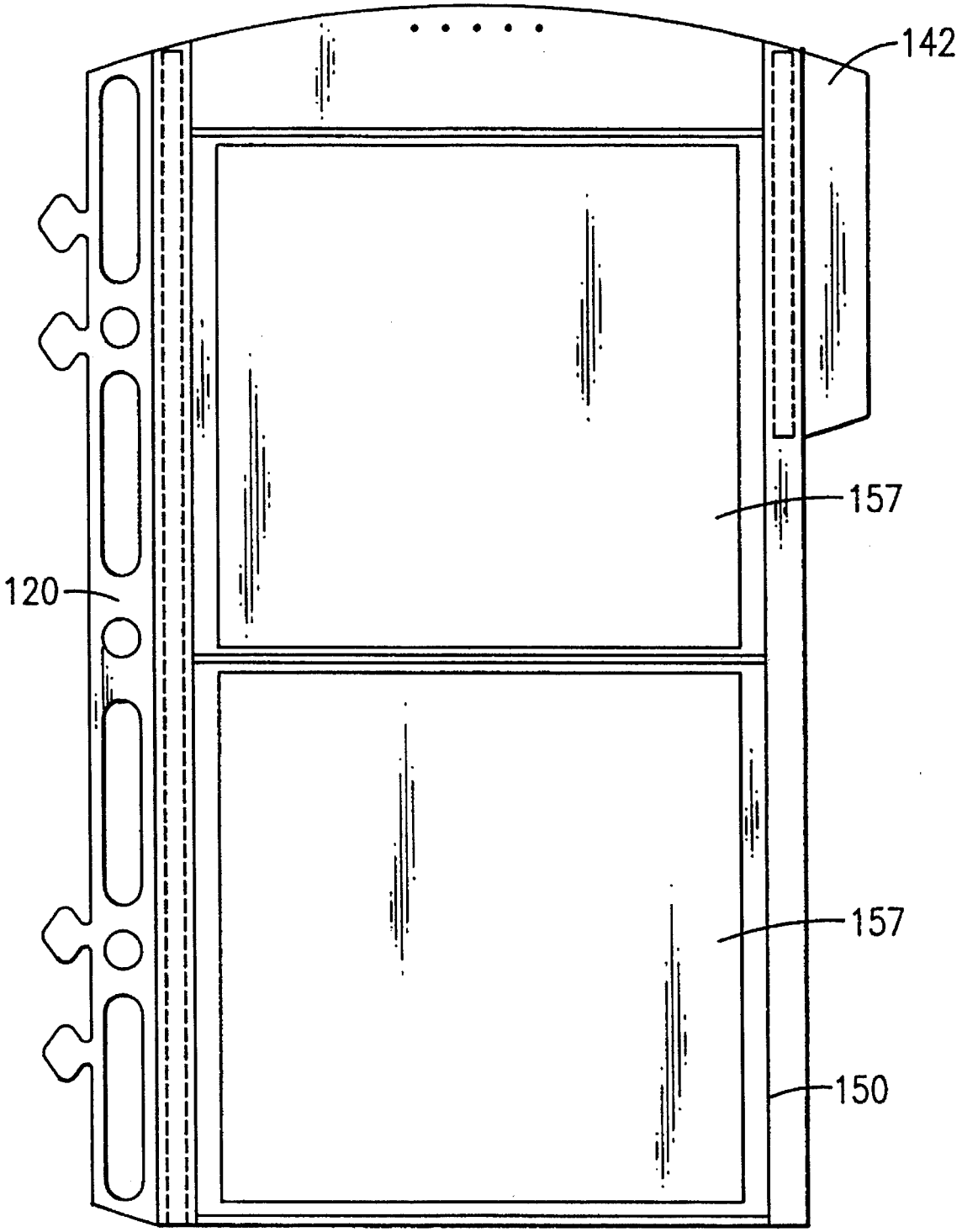
FIG. 15 is a plan view of an alternative work platform.

As shown in FIGS. 13 and 14, a notepad work platform 150 can be used with the same attachment column 120 in place of the electronic organizer of FIG. 9. Here the work platform has a body 152 of the same general dimensions as the electronic organizer. The body 152 has a recessed central portion 154 that holds a notepad 156. In an alternative version, this portion 154 can hold one or more pads of "yellow-sticky" removable adhesive note pads 157, 157 (FIG. 15).

As with the electronic organizer 116, the notepad work platform body 152 has left and right profiled channels 158 and 160, and these fit onto the slide member 126 of the attachment column 120. Also as with the electronic organizer, the tab 142 can be inserted into one of the two channels (here channel 158) when the attachment column 120 is installed in the other channel (here channel 156). The tab 142 is repositionable along the length of the channel.

Figure 16:
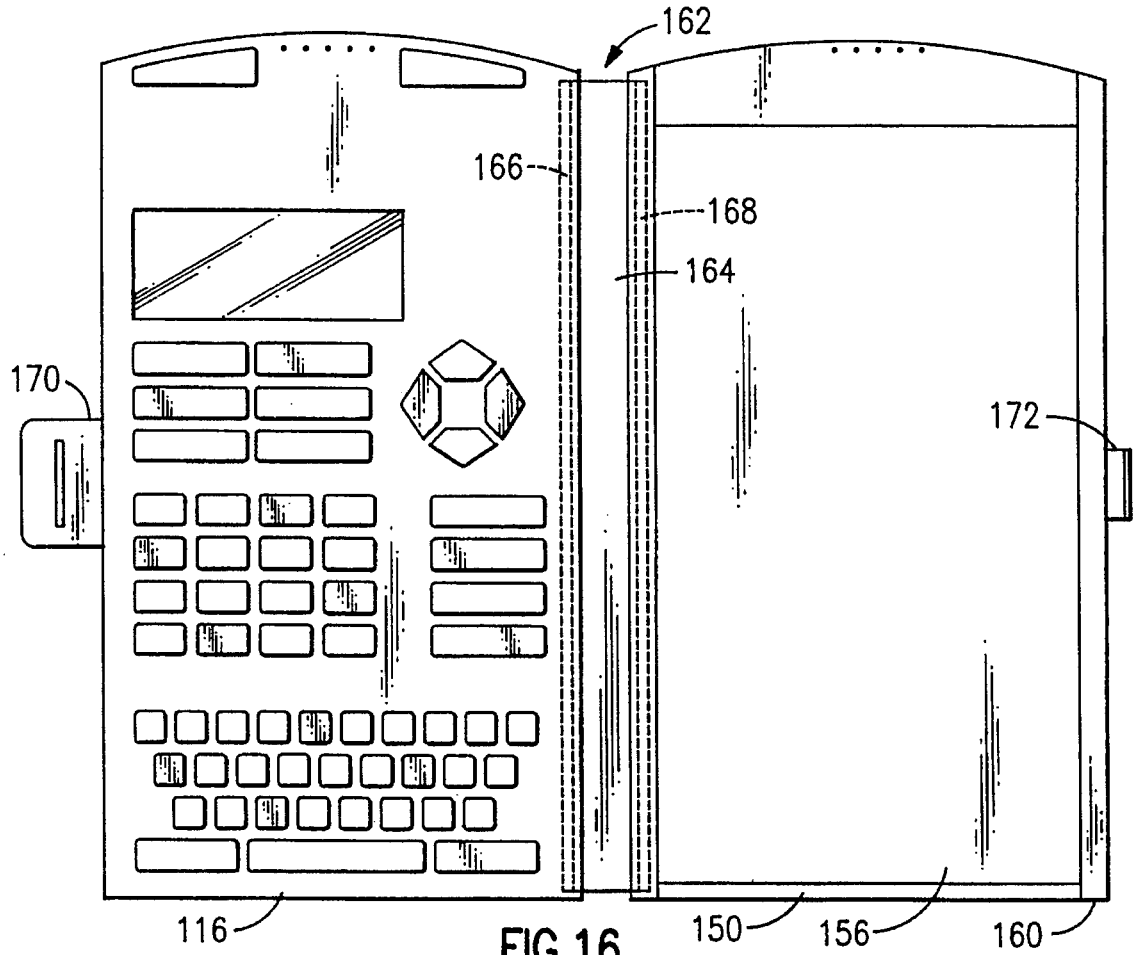
FIGS. 16 and 17 are plan and cross sectional views of an assembly formed of the electronic organizer, a notepad work platform, and a hinge member.
Figure 17:
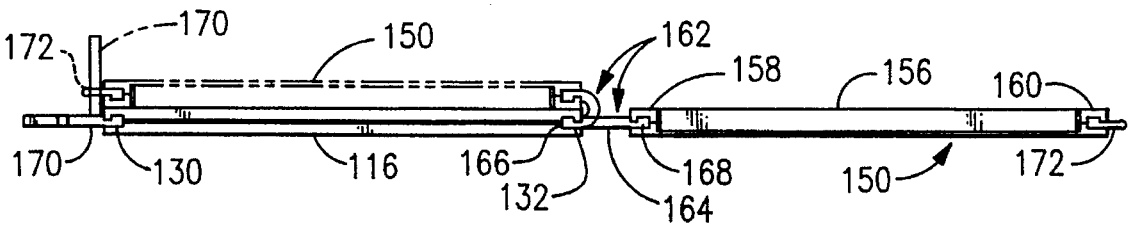

Now turning to FIGS. 16 and 17, the electronic organizer 116 can be joined together with the notepad work platform 150 to make a closable arrangement, with the notepad work platform 150 serving as a cover for the electronic organizer 116. In this case, a hinge member 162 joins the two major components, and includes an elongated flexible web member 164 which has profiled slide members 166 and 168 along each edge. These slide members fit into the right channel 132 of the electronic organizer and the left channel 158 of the notepad work platform, respectively. The web 164 can be a living hinge of a flexible plastic material or can include a mechanical hinge, as desired. The electronic organizer 116 and the platform 150 close together by folding at the hinge member 162, as shown in ghost line in FIG. 17.

First and second latching tab members 170 and 172 have profiled slide members that slide-fit into the channels 130 and 160 of the electronic organizer and the notepad work platform, respectively. These latching tab members 170 and 172 interlock to hold the assembly closed, as also shown in ghost in FIG. 17.

Of course, the positions of the platform 150 and electronic organizer 116 can be interchanged right for left, simply by sliding the hinge member 132 out and sliding it into the other two channels 130 and 160. The latching tab members 170 and 172 would then also be likewise repositioned.

Figure 18:
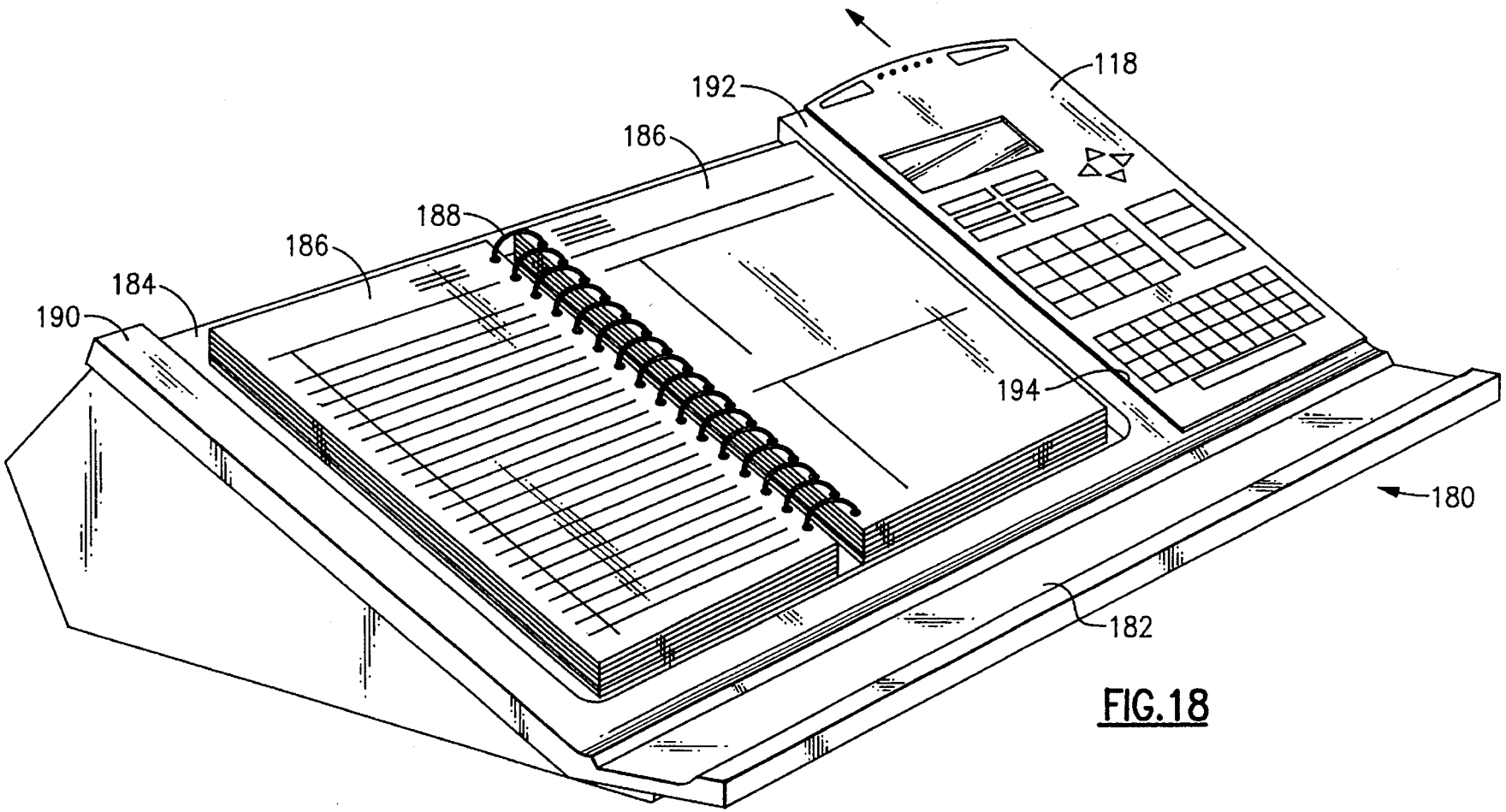
FIGS. 18 and 19 are perspective views of a desk calendar assembly employing the electronic organizer according to an embodiment of this invention.
Figure 19:
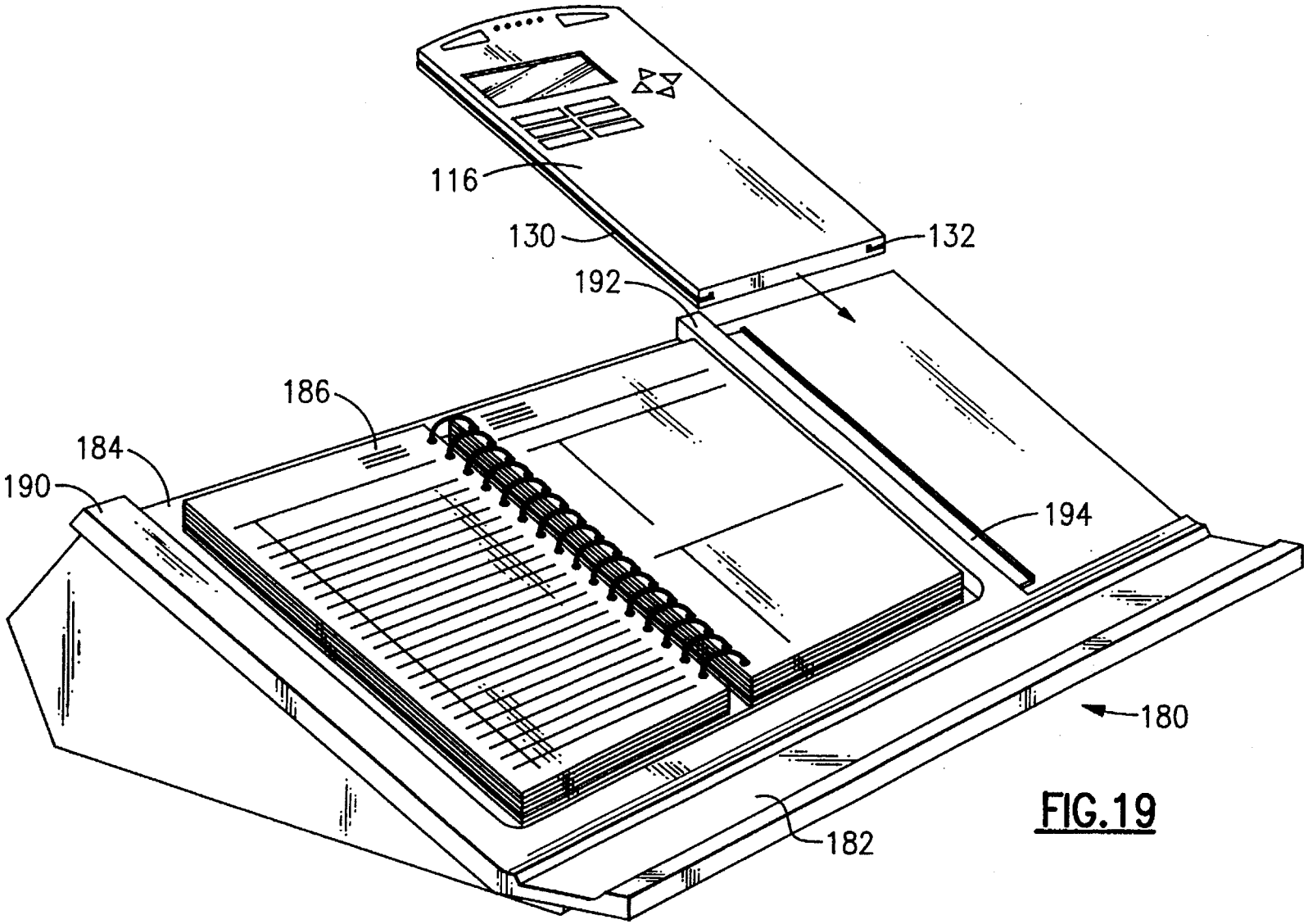

A further illustrative embodiment of the inventive concept is shown as a desk calendar assembly 180 in FIGS. 18 and 19. In this assembly, a rigid base member 182 receives a slide-in calendar 184, which has date pages 186 that are loosely bound on a series of rings 188 that define a spine of the calendar. Formed on the base member 182 are left and tight retaining flanges 190 and 192 that hold the slid-in calendar 184. On one side of the base member 182, here shown disposed on the tight retaining flange 192, is a profiled slide member 194. The slide member 194 has a similar profile to that of the attachment column described above, and extends parallel to the spine of the calendar. The electronic organizer 116 (or notepad work platform 150, if preferred) is removably held on this profiled slide member 194. The electronic organizer or other work platform is thus available for use on the user's desktop, but can be easily removed by sliding it out (FIG. 18). Then the electronic organizer can be installed onto the attachment column 120 for use with a host book, or can be joined by means of the hinge member 162 to the notepad work platform 150. In this way the user can continue to work with the same device while out of the office at a meeting or while traveling. The electronic organizer can later be reinstalled on the calendar base 182 by sliding it onto the profiled slide member, as shown in FIG. 19.

While this invention has been described with reference to selected preferred embodiments, it should be understood that the invention is not limited to those precise embodiments. Rather, many modifications and variations will present themselves to persons skilled in the art without departing from the scope and spirit of this invention, as defined in the appended claims.

We claim:

1. An electronic organizer assembly for removable attachment to a host book wherein said host book has a spine, a plurality of leaves, and a plurality of ring members arranged along said spine for loosely retaining said leaves; said electronic organizer assembly comprising:

an insert for removably attaching to the ring members of said host book, including a flange for removably engaging said ring members; and an elongated slide engaging member that extends in the direction along said spine, and having a predetermined profile; and an electronic organizer including a flat generally rectangular body, at least one work panel disposed on a front face of said body; and first and second slide portions formed at longitudinal side edges of said rectangular body, each of said slide portions being profiled to match said slide engaging member such that said electronic organizer can be changed over from a right-side to a left-side orientation by sliding said body longitudinally along said slide engaging member until the latter slides out of engagement with the first slide portion, flipping said body over to engage the second slide portion with said slide engaging member, and then sliding the second slide portion along said slide engaging member until the body is fully engaged with said insert.

2. An electronic organizer assembly according to claim 1, wherein said slide engaging member is an elongated rod extending along said flange, and said first and second slide portions are each in the form of a slotted channel extending along the respective side edge of said body.

3. An electronic organizer assembly according to claim 1, wherein said insert is adapted for use with openable binder ring members, and said flange includes holes for engaging the ring members.

4. An electronic organizer assembly according to claim 1, wherein said insert is adapted for use with wire-bound host book in which the ring members are formed as a series of coils of wire, and said flange includes spade members for engaging said ring members between said coils of wire.

5. An electronic organizer assembly according to claim 1, wherein said slide engaging member has at least one detente formed thereon at a predetermined location, and each of said first and second slide portions has a corresponding detente engaging member for engaging said detente when the respective slide portion of said body is fully engaged with said insert.

6. A workstation assembly for removable attachment to a host book wherein said host book has a spine, a plurality of leaves, and a plurality of ring members arranged along said spine for loosely retaining said leaves; said workstation assembly comprising an attachment insert for removably attaching to the ring members of said host book, including a flange portion for removably engaging said ring members, and an elongated slide engaging member that extends in the direction along said spine, and having a predetermined profile; and a work platform member including a flat generally rectangular body, at least one work panel disposed on a first face of said body; and fist and second slide portions formed at longitudinal side edges of said rectangular body; each of said slide portions being profiled to match said slide engaging member such that said work platform member can be changed over from a right-side to a left-side orientation by sliding said body longitudinally along said slide engaging member until the latter slides out of engagement with the first slide portion, flipping said body over to engage the second slide portion with said slide engaging member, and then sliding the second slide portion along said slide engaging member until the body is fully engaged with said insert.

7. A work station assembly according to claim 6 wherein said slide engaging member has a stepped profile defining a longitudinal slot on one side thereof, and said slid portions each include a profiled slot having a corresponding stepped profile defining a longitudinal ridge for engaging said longitudinal slot.

8. A work station assembly according to claim 6 further comprising a second attachment member including an elongated slide engaging member that has said predetermined profile for slidably engaging one of said first and second slide portions when the other of said slide portions is engaged with said attachment insert.

9. A hinged, detachable note pad and electronic organizer assembly comprising a note-pad work platform including a flat generally rectangular body carrying a note pad on a first face therof, and first and second slide portions formed at longitudinal side edges of said rectangular body, each of said slide portions having a predetermined profile;

an electronic organizer including a flat generally rectangular body of substantially the smae dimensions as said work platform, with at least one work panel being disposed on a first face of said body; and third and fourth slide portions formed at longitudinal side edges of said electronic organizer body, each of said third and fourth slide portions having said predetermined profile;

a flexible hinge member detachably joining said note-pad work platform and said electronic organizer, including an elongated flexible web and first and second slide engaging members formed at longitudinal side edges of said flexible web and each having a profile corresponding to said predetermined profile for slidably engaging one of said first and second slide portions and slidably engaging one of said third and fourth slide portions.

10. The note pad and electronic organizer assembly of claim 9 further comprising first and second latch members for releaseably engaging one another when said assembly is closed with said note-pad work platform positioned atop said electronic organizer, each said first and second latch member including a respective slide engaging member having a profile corresponding to said predetermined profile for respectively engaging the others of said first and second slide portions and of said third and fourth slide portions.

11. A combination of a work platform and a host book wherein said host book has a substantially rigid base, as spine, a plurality of leaves, and ring members arranged along said spine for loosely retaining said leaves, and an elongated attachment column affixed on said rigid base and extending parallel to said spine, said attachment column carrying an elongated slide engaging member having a predetermined profile; and a work platform member including a flat generally rectangular body, at least one work panel disposed on a first face of said body; and at least a first slide portion formed at a longitudinal side edge of said rectangular body; each said slide portion being profiled to match said slide engaging member such that said work platform member is removably attached to said base by sliding said rectangular body longitudinally along said slide engaging member with said first slide portion engaged therewith.

* * * * *